US006393650B1

(12) United States Patent
Gerakos

(10) Patent No.: US 6,393,650 B1
(45) Date of Patent: May 28, 2002

(54) MARGIN TROWEL WITH BUCKET HOOK

(76) Inventor: David Nicholas Gerakos, 2780 50th Ave. W. #6, Bradenton, FL (US) 34207

( * ) Notice: Subject to any disclaimer, the term of this patent is extended or adjusted under 35 U.S.C. 154(b) by 0 days.

(21) Appl. No.: 09/772,769

(22) Filed: Jan. 30, 2001

(51) Int. Cl.[7] ..... A47L 13/02; B05C 17/00
(52) U.S. Cl. ..... 15/235.4; 15/143.1
(58) Field of Search ..... 15/235.4, 235.8, 15/143.1

(56) References Cited

U.S. PATENT DOCUMENTS 5,706,546 A 1/1998 Utley

*Primary Examiner*—Randall E. Chin
(74) *Attorney, Agent, or Firm*—Dorthy S. Moore

(57) ABSTRACT

A hand trowel having a flat blade, a handle, an angled stem, and a bucket hook which has a length dimension of approximately one-and-one-half inches and extends beyond the attachment point of one end of the stem to the blade. Thus, the trowel can be stored in a substantially vertical, secure and fixed position on the lip of a bucket, preventing the handle from coming into contact with the contents of the bucket, or the contents being inadvertently spilled onto the work area. It also has a larger blade than is typically used for semi-fluid masonry products, to carry more product at a time to the working area, as well as act as a counterweight for the handle to keep the tool from falling out of bucket when it is moved. Thus, the present invention allows the operator to work more efficiently, and maintain a cleaner, less cluttered working area.

10 Claims, 4 Drawing Sheets

MARGIN TROWEL WITH BUCKET HOOK

BACKGROUND—FIELD OF INVENTION

This invention relates to tools for use with masonry products that are mixed in and scooped out of a 5-gallon bucket or other similar container having an upper lip, specifically to a time-saving troweling tool having an elongated bucket hook, an enlarged blade, and an angled stem between the handle and the blade, the enlarged blade allowing more masonry product to be scooped from the bucket at one time, the enlarged blade also becoming a counterweight for the handle to maintain the troweling tool in a securely suspended position on the lip of a bucket between uses, and in an orientation that permits excess setting materials to be easily and neatly returned to the bucket; keeps the handle clean and free of masonry product; keeps the handle in a position readily accessible for subsequent use; helps to keep the work area clean and uncluttered; and maintains the troweling tool in a fixed and out-of-the-way position until it is again needed for use.

BACKGROUND—DESCRIPTION OF PRIOR ART

Masons and tile setters often use 5-gallon buckets to hold semi-fluid masonry products, such as thinset, grout, and other setting materials. These buckets are inexpensive and have become a standard container for working with masonry product that is too wet to be troweled from a board. Commonly, the semi-fluid masonry products are scooped out of the bucket by using a square margin trowel. Then, when the trowel is not being used, its blade is usually placed in a resting position on the upper lip of the bucket. However, this practice often results in the trowel falling into the bucket and the handle at least becoming partially covered with the masonry product, particularly when the bucket is bumped or slid across the floor. Work is slowed each time the handle of the margin trowel must be cleaned prior to a subsequent use. Another temporary placement option for the trowel when it is idle, is to set it directly on the working surface. One of the disadvantages of this practice is that the trowel usually gets in the way. Also, placing it on the working surface typically requires that the trowel be cleaned of excess masonry product prior to doing so, a labor increasing step that is avoided by use of the present invention.

Although the industry is growing, there have been no significant advances in margin trowels for decades. The currently produced margin trowels typically have a standard width dimension of no more than 2 inches. Although they are currently produced in a variety of lengths, their narrow width limits the amount of material they can hold and transfer from a bucket with each scooping motion made into it to obtain masonry product. This means that the user must return to the bucket several times in order to get a working amount of the masonry product, an inefficient process at best. A reduction in the number times that a tile setter or mason would need to scoop masonry product from a bucket, would save time and energy, resulting in a tile setter that is more productive and one that would need to spend less time on his knees.

The invention thought to be the closest to the present invention is U.S. Pat. No. 5,706,546 to Utley (1998). However, the Utley invention can be distinguished from the present invention in numerous ways. The Utley disclosure reveals a semi-cylindrical scoop with top and bottom ends, a handle, a deflector shield attached to the bottom of the handle and having a larger diameter dimension than the handle, a short stem axially aligned with the handle that connects the handle to the scoop, and a short hook downwardly depending from the deflector adjacent to the stem. Further, when the Utley invention is suspended on the lip of a bucket, it is a portion of the deflector that supports it. One disadvantage of the Utley invention is that although it has a considerably larger surface area than many of the two-inch wide margin trowels used today, the semi-cylindrical cavity in the Utley scoop makes it inadequate as a mixing tool for semi-fluid masonry products. In addition, the area within the semi-cylindrical cavity of the Utley invention would be difficult to clean after use with masonry products, and it would not allow easy return of excess mortar or grout to the bucket. Further, the short length of the hook in the Utley invention, as well as the axial alignment of the stem and handle, place a majority of the mass of the Utley invention within a bucket, during its suspension on the upper lip of the bucket, resulting in a likelihood that the Utley invention on occasion could be easily knocked into the bucket, or fall into the bucket during transport. In contrast, the present invention has an elongated bucket hook extending below the connection of its stem to its blade, as well as an angled stem that places much of the stem and the entire handle outside of the bucket perimeter, making it less likely to be inadvertently knocked into the bucket than the Utley invention. The enlarged blade of the present invention is used as a counterbalancing weight, which prevents the present invention from being easily knocked out of the bucket, even when the bucket is bumped or slid across the floor. Another difference between the present invention and the Utley invention is that when the present invention is suspended on the lip of a bucket, it is supported by the portion of the stem adjacent to its blade, which is in an orientation substantially perpendicular to the blade. As mentioned above, the Utley invention is not supported by its stem, but instead by a portion of its deflector, as its stem is in a position substantially parallel to the side of the bucket upon which it is suspended. Therefore, the present invention is not the same as the Utley invention, and no invention is known that has all of the features and advantages of the present invention.

SUMMARY OF OBJECTIVES AND ADVANTAGES

It is the primary object of this invention to provide a time-saving troweling tool that can be securely maintained between uses in an out-of-the-way position on the upper lip of a five-gallon bucket or other similar container. It is a furher object of this invention to provide a troweling tool that can be supported by the upper lip of a bucket so that the masonry product that drips off the trowel will be contained inside the bucket. It is also an object of this invention to provide a troweling tool with a larger blade than is commonly used today, that will hold more materials as well as act as a counterweight for the handle to prevent the tool from falling out of the bucket during transport or when the bucket is slid across a floor, or from being easily knocked out of the bucket when it is inadvertently bumped. A furher object of this invention is to provide a temporary means of storage for a troweling tool that is used intermittently, which does not allow the troweling tool handle to come in contact with the setting materials in a bucket while idle. It is also an object of this invention to provide a troweling tool that is easy to clean and easy to keep clean. It is a further object of this invention to provide a troweling tool that can be maintained in a secure, fixed elevated position away from the working surface, so as not to clutter it. It is also an object of this invention to provide a troweling tool that although it might not offer any manufacturing cost savings over prior art trowels, since there have been no new advances in margin trowels for decades, its improvements would have a competitive advantage in the marketplace.

As described herein, properly manufactured and used, the present invention would provide a labor-saving flat margin trowel with an elongated bucket hook to temporarily hold the trowel in a fixed position on the lip of a 5-gallon bucket when it is between uses. It would be in a readily accessible position for subsequent use, but not directly on the working surface where it could get in the way or potentially drip masonry product onto the working surface. Time-savings would occur since those using the present invention would promptly know where it is located each time it is needed for use, and be able to directly access it for applying more masonry product to the working surface. Since the elongated hook on the present invention would allow it to be securely supported on the bucket lip, the handle of the present invention would not fall into the bucket supporting it and become contaminated with masonry product, even when the bucket is bumped or slid across the floor. Also, the enlarged blade would act as a counterweight for the handle of the present invention, to keep the tool from becoming unbalanced and falling outside the bucket and onto the working surface where it could deposit masonry product and make a mess. This means less mess, and less time cleaning. The present invention would further save time, since it has a larger blade than currently used trowels and would be able to carry more material out of a bucket with each scooping motion, and can be securely maintained between uses in an out-of-the-way position on the upper lip of a bucket. This larger blade would deliver twice as much masonary product with every scoop, enough to set four square feet of tile, instead of only two square feet. It would also save time since the working surface would remain less cluttered and be maintained in a cleaner condition. Further, excess masonry product would not have to be cleaned from the troweling tool before it is set down on the working surface since it would instead be placed on the upper lip of a bucket, and in its temporary suspended position on the upper lip of a bucket masonry product would drip off the trowel into the bucket, not on the working surface. The handle of the present invention would also be larger than prior art margin trowels, adding comfort that makes a job seem easier to its user. Also, the flat configuration of the present invention makes it easy to clean and easy to keep clean. All of these improvements in combination make a troweling tool that permits a tile setter to spend less time on his knees, and thereby be more productive.

Although the description above contains many specific references to dimensions, shapes, materials, and the like, these should not be construed as limiting the scope of the invention but as merely providing illustrations of some of the presently preferred embodiments of this invention. For example, blade 18 could have other shapes, such as triangular, trapezoidal, and the like, as well as various thickness dimensions. Also, handle 10 could have other shapes, diameter dimensions, or consist of other materials. Thus the scope of the invention should be determined by the appended claims and their legal equivalents, rather than by the examples given.

Figure 1A:
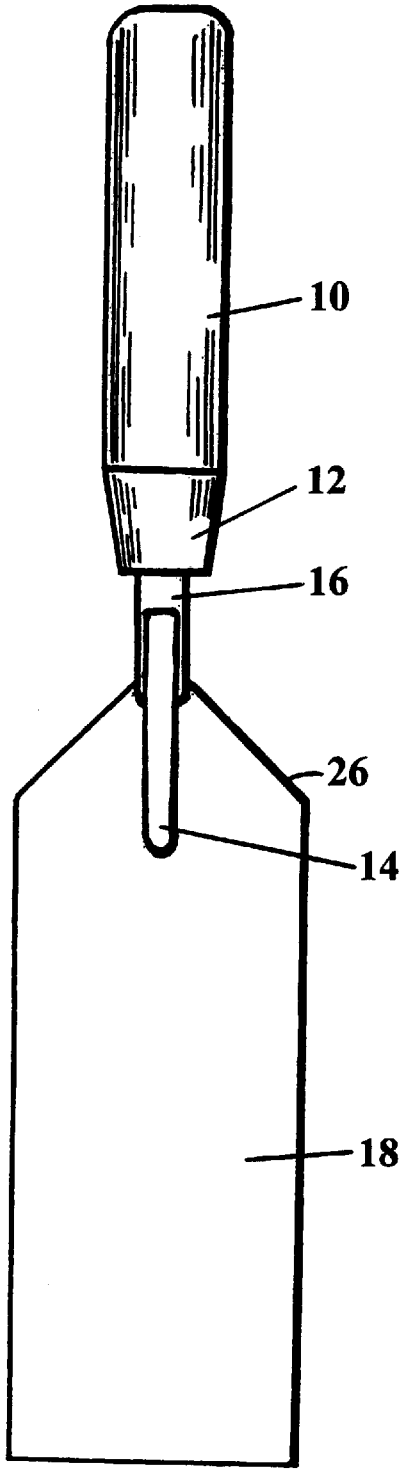
FIG. 1A is a front view of a first embodiment of the present invention trowel having a welded metal bucket hook depending downwardly from the stem connecting the trowel handle to its blade.

| REFERENCE NUMERALS USED IN DRAWINGS | |
|---|---|
| 10 handle | 12 ferule |
| 14 metal bucket hook | 16 stern |
| 18 blade | 22 molded hook |
| 24 bucket | 26 back corner or frog |
| 28 present invention trowel | |

DESCRIPTION OF PREFERRED EMBODIMENTS.

The present invention provides a time-saving troweling tool for scooping masonry products, such as thinset, grout, and other setting materials out of a five-gallon bucket, or other similar container. It has a large blade, an elongated bucket hook positioned substantially parallel to the blade, and an angled stem between the handle and the blade, the enlarged blade allowing more masonry product to be scooped from the bucket at one time, the enlarged blade also becoming a counterweight for the handle to maintain the troweling tool in a securely suspended position on the lip of a bucket without being susceptible to being easily knocked out of the bucket or easily falling into the bucket during transport, when the bucket is bumped, or when the bucket is slid across a floor, and its handle will remain free of masonry product. Positioning of the troweling tool on the bucket lip also permits excess masonry product which remains clinging to the trowel after use to be easily and neatly returned to the bucket; keeps the handle clean and readily accessible for subsequent use; helps to keep the work area clean and uncluttered; and maintains the troweling tool in a fixed and out-of-the-way, although close-at-hand, position until it is again needed for use.

Figure 1B:
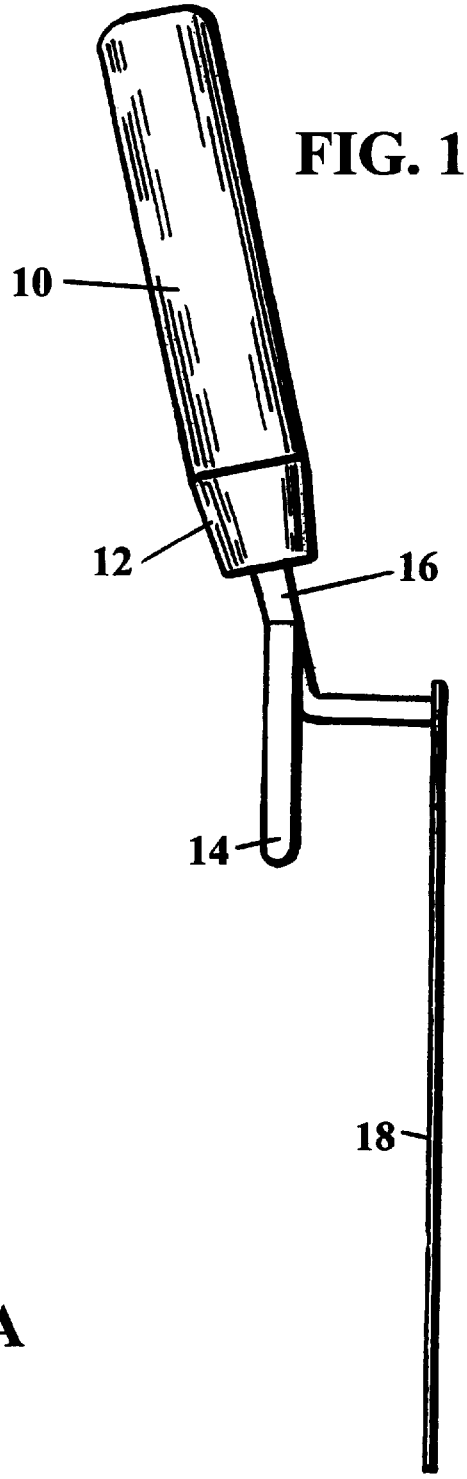
FIG. 1B is a side view of the first preferred embodiment.
Figure 3:
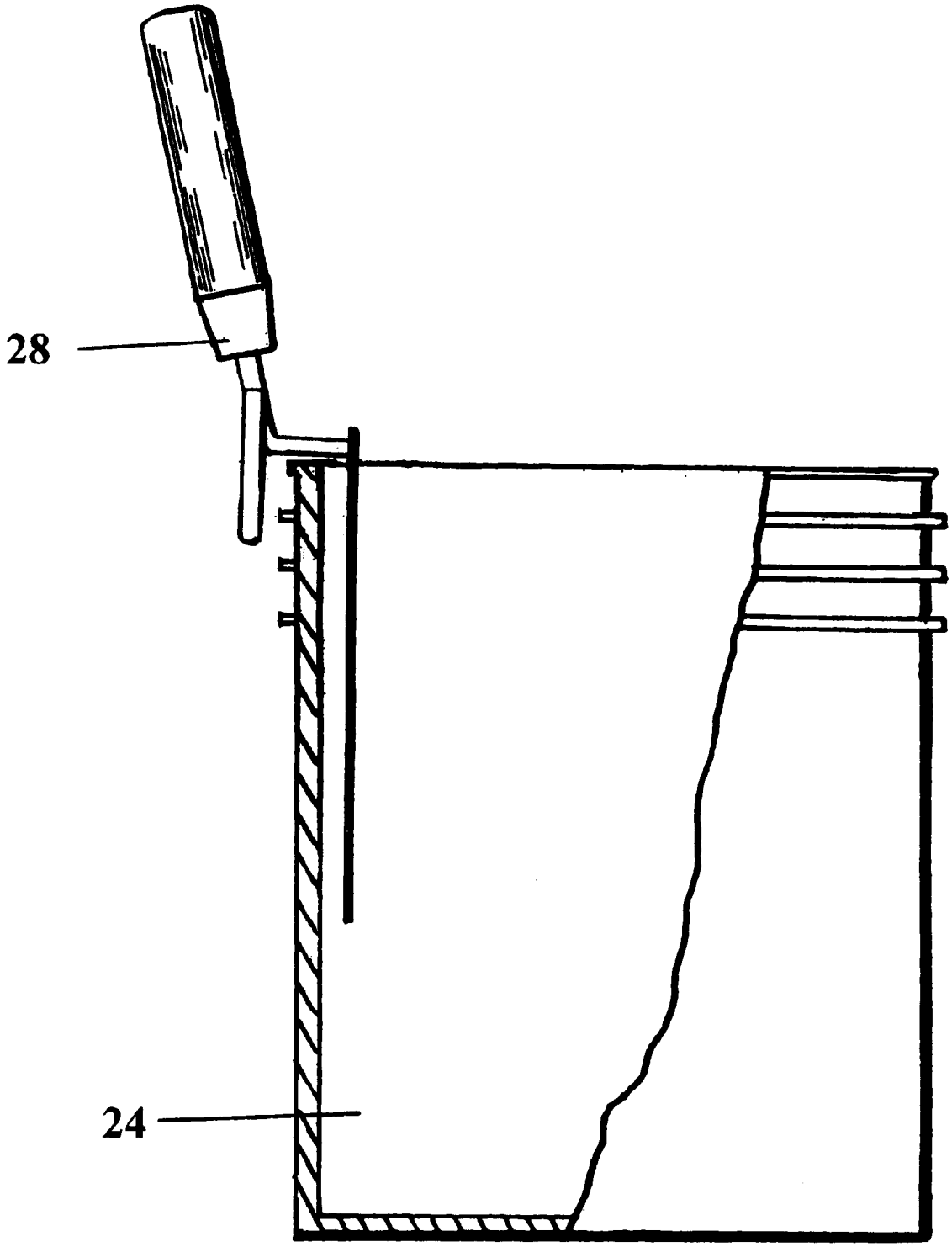
FIG. 3 is a side view of the first preferred embodiment with its bucket hook being used to suspend its blade inside a bucket, with its handle remaining outside of the bucket.
Figure 4:
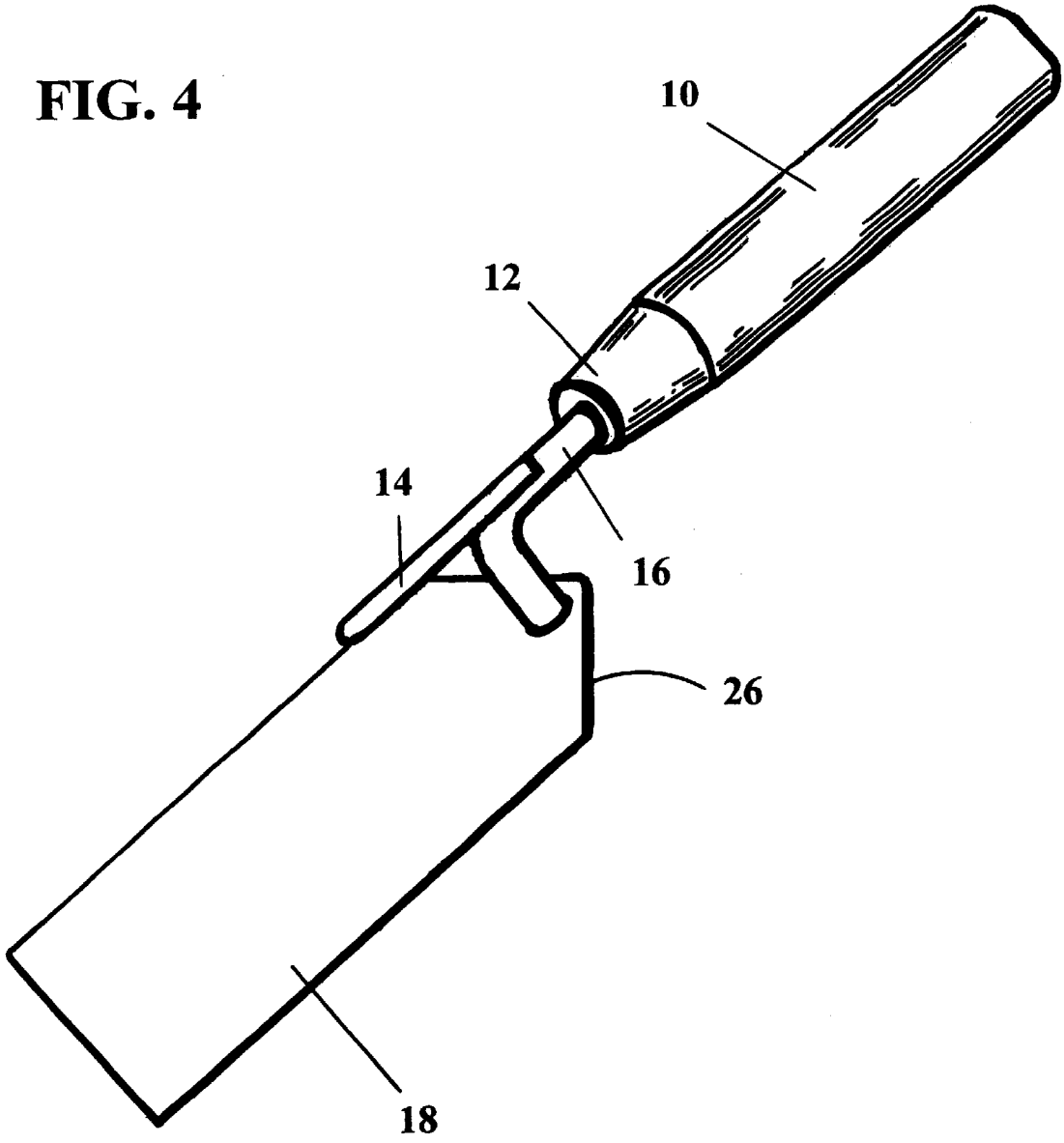
FIG. 4 is a perspective view of the first preferred embodiment showing the welded metal bucket hook being oriented substantially parallel to the blade.

A first preferred embodiment of the present invention trowel is illustrated in FIGS. 1A, 1B, 3 and 4. FIGS. 1A and 1B show the present invention trowel in the vertically extending position it would assume when suspended over the upper lip of a bucket, such as the five-gallon bucket 24 in FIG. 3. FIG. 4 also shows the first preferred embodiment, although from a perspective view. FIGS. 1A, 1B, and 4 all show the first preferred embodiment having a handle 10 with a metal ferule 12 positioned adjacent to the lower end of handle 10. Ferule 12 is shown to have a tapering configuration, with the smaller end positioned remote from handle 10. Although not limited thereto, in the preferred embodiment it is contemplated for handle 10 to be made from wood and have a polyurethane finish. However, it is also contemplated for handle 10 to consist of any other material that is rigid and relatively light in-weight, such as various plastics, rubber, or fiber reinforced resins, so that handle 10 is not unduly heavy for repeated use, but able to adequately support the weight of masonry products (not shown) lifted by the present invention from bucket 24 in FIG. 3. FIGS. 1A, 1B, and 4 further show the first preferred embodiment of the present invention having a blade 18 attached to the lower end of an angled stem 16. The connection between blade 18 and stem 16 is shown in FIGS. 1B and 4 to be approximately 90°, with an obtuse angle positioned between the lower and upper ends of stem 16. FIGS. 1A, 1B, and 4 show the upper end of stem 16 being axially aligned with handle 10, and connected to handle 10 through ferule 12. Although not critical and not shown, in the first preferred embodiment it is contemplated that the connection between blade 18 and stem 16 would be made through welding or riveting. Further, although not limited thereto, in the first preferred embodiment it is contemplated for the connection between the upper end of stem 16 and handle 10 to be made by pressing and/or gluing stem 16 into handle 10, with metal ferule 12 positioned between handle 10 and stem 16.

FIGS. 1A, 1B, and 4 also show the first preferred embodiment of the present invention having an elongated metal bucket hook 14 attached to the upper portion of stem 16. In the first preferred embodiment it is contemplated for hook 14 to be made from round metal stock, similar in diameter to the material used for stem 16. The proximal end of hook 14 is connected centrally to the upper portion of stem 16, near to ferule 12, with the distal end of hook 14 extending downwardly beyond the connection of the lower portion of stem 16 to blade 18. The resulting orientation of hook 14 in the first preferred embodiment is approximately parallel to blade 18. Although not limited thereto, it is contemplated that hook 14 be welded to the upper portion of stem 16 and exhibit a length dimension of approximately one-and-one-half inches. A hook 14 having a length dimension significantly longer than one-and-one-half inches would be undesirable, as it would come into contact with masonry products (not shown) being scooped from a container, such as bucket 24 shown in FIG. 3. Also, a hook 14 significantly shorter than one-and-one-half inches may not be sufficient in length to hold the present invention trowel in a secure position on the lip of a container, particularly during transport of the container, or when it would be inadvertently bumped or slid across a floor.

Further, in the first preferred embodiment, although not limited thereto, blade 18 would typically have a thickness dimension of approximately one-sixteenth of an inch, with width and length dimensions of approximately three inches and eight-and-one-half inches, respectively. Also, in FIGS. 1A, 1B, 3, and 4, the length dimension of handle 10 is shown to be slightly greater than one-half the length of blade 18. The large width of blade 18, relative to the common two-inch width of prior art margin trowels, would provide a more effective counterweight to handle 10, preventing the trowel from falling outside of the container upon which it is supported, such as the-five-gallon bucket 24 shown in FIG. 3. The larger width and surface area dimensions of blade 18, also allow a user to scoop more materials (not shown) from bucket 24 at one time. However, if blade 18 were made to have width and length dimensions much larger than three inches and eight-and-one-half inches, respectively, it would be difficult to use as a mixing tool within bucket 24. Although not critical but preferred as a safety feature, the back comers or frogs 26 of blade 18 are typically beveled or rounded to avoid personal injury or snagging. FIGS. 1A and 4 show the beveled configuration of back corners or frogs 26.

Figure 2A:
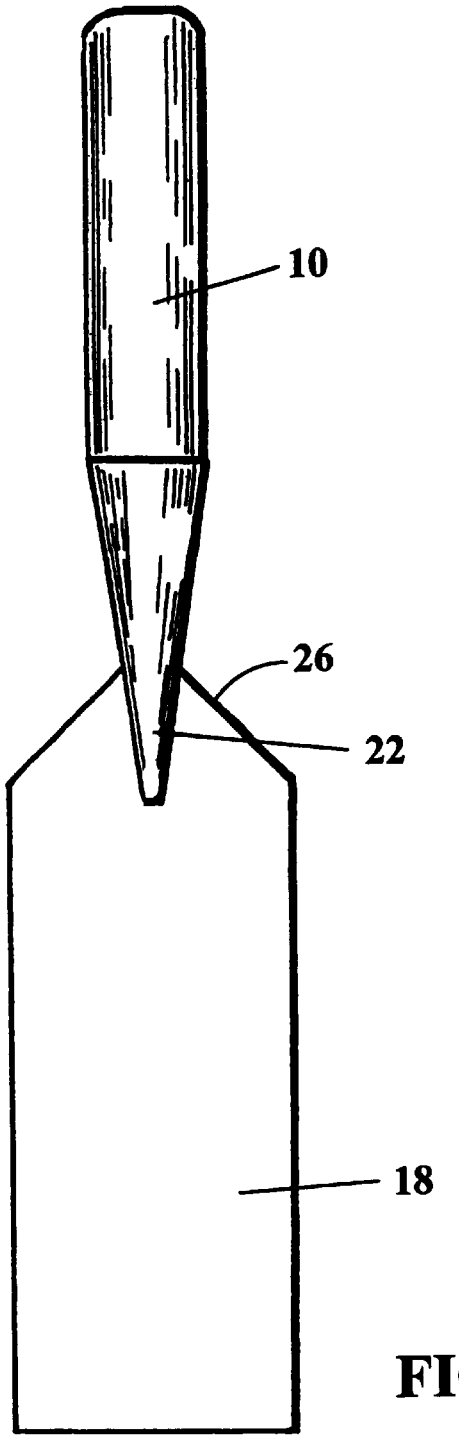
FIG. 2A is a front view of a second embodiment of the present invention trowel having a molded plastic bucket hook formed into its handle and downwardly depending from the lower end of the handle.
Figure 2B:
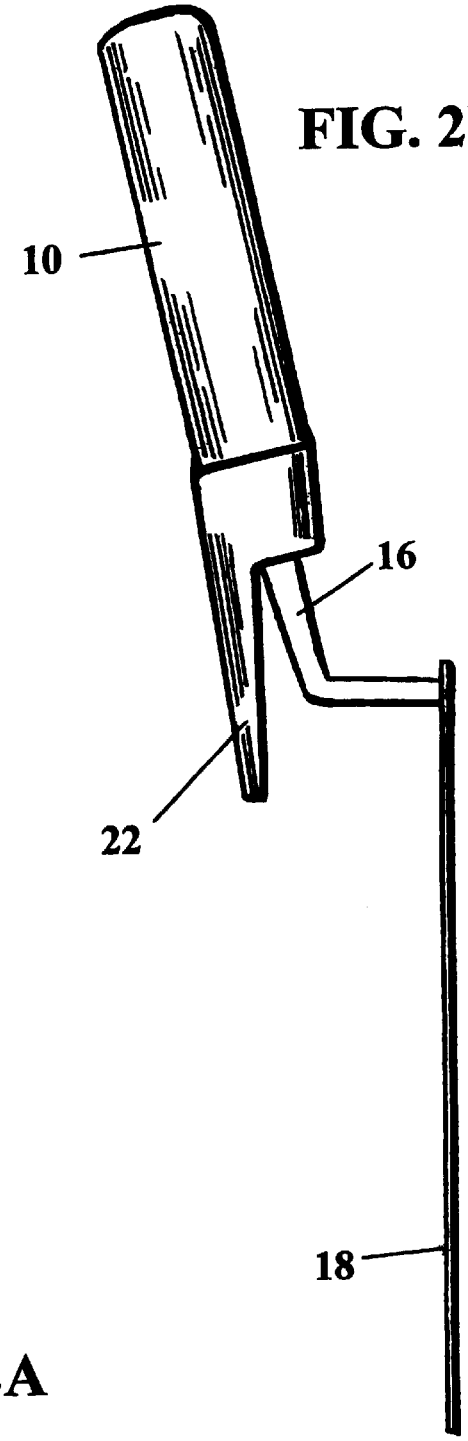
FIG. 2B is a side view of the second preferred embodiment.

FIG. 2A and FIG. 2B show a second embodiment of the present invention trowel having a blade 18 connected to the lower end of an angled stem 16, with the upper end of stem 16 being axially aligned with and connected to a handle 10. In FIG. 2A and FIG. 2B, handle 10 has a configuration that incorporates the ferule 12 shown in the first embodiment in FIGS. 1A and 1B. FIG. 2A and FIG. 2B also show a molded hook 22 downwardly depending from the lower end of handle 10, with handle 10 and molded hook 22 being made as a single unit through molded construction, from sturdy molded materials, such as plastic. As in the first preferred embodiment, molded hook 22 is positioned so as to be approximately parallel to blade 18. Also, although not critical thereto, FIG. 2A also shows the second preferred embodiment having the safety feature of back comers or frogs 26 on the upper end of blade 18 which are beveled. It is also contemplated for the thickness dimension of the blade 18 in the second preferred embodiment to be approximately one-sixteenth of an inch, for molded hook 22 to extend downwardly from the ferule-like portion of handle 10 approximately one-and-one-half inches and extend beyond the connection of the lower portion of stem 16 to blade 18, and for the width and length dimensions of blade 18 to be approximately three inches and eight-and-one-half inches, respectively.

FIG. 3 shows stem 16 being used to securely support handle 10 of the first preferred embodiment trowel 18 upon the upper lip of a bucket 24. Blade 18 downwardly extends into bucket 24, with hook 14 in an opposed position thereto near to the outside surface of bucket 24. When trowel 28 is not in the hand of the user (not shown), it can be rested on the lip of bucket 24 wherein excess masonry product can easily and neatly drip from blade 18 back into bucket 24. Hook 14 prevents handle 10 from falling into the interior of bucket 24, and coming into contact with the masonry product (not shown) in bucket 24. In contrast, the enlarged blade 18 provides a counterweight to prevent trowel 18 from being easily knocked from its perch on the lip of bucket 24, and falling outside of bucket 24. The enlarged blade 18 also permits delivery of approximately twice the masonry product possible with prior art margin trowels having only a two inch width dimension, so that every scoop with the present invention can provide enough masonry product to set four square feet of tile, instead of only two square feet. The combination of hook 14 and enlarged blade 18 also provide a means of keeping trowel 28 off of the working surface (not shown) to help maintain a neater and cleaner work area. With the ability to securely retain blade 18 within the interior of bucket 24, but without letting handle 10 come in contact with the masonry product (not shown) inside of bucket 24, any masonry product that drips off of blade 18 will be readily contained within bucket 24. Thus, the present invention trowel 28 allows an operator (not shown) to be more organized, handle more masonry product with less motion, spend less time cleaning trowel 28 and the working surface, and thereby be more efficient and productive during his or her time on a construction or renovation job site.

I claim:

1. An improved hand troweling tool for moving and scooping setting materials and masonry product, of the type comprising a flat blade, an offset handle, and an angled stem attached to the blade which is adapted for connecting the handle to the blade in an offset position therefrom, wherein the improvement comprises said troweling tool having a hook adapted for suspending said troweling tool on the lip of a container, said hook being approximately one-and-one-half inches in length, positioned at a spaced apart distance from the blade and substantially parallel thereto with the stem between said hook and the blade, and extending beyond the attachment point of the stem to the blade.

2. The troweling tool of claim 1 wherein said hook is attached to the handle, and the handle and said hook are made as a single unit from molded construction.

3. The troweling tool of claim 1 wherein said hook is attached to the stem.

4. The troweling tool of claim 1 wherein the improvement further comprises the blade having enlarged width and length dimensions of approximately three inches and eight-and-one-half inches, respectively.

5. The troweling tool of claim 1 wherein the blade has a thickness dimension of approximately one-sixteenths of an inch.

6. A hand troweling tool comprising:

(a) a flat blade adapted for mixing and scooping setting materials and having an upper end;

(b) an angled stem attached to said upper end;

(c) a handle attached to said angled stem in a position offset from said blade; and (d) a hook being approximately one-and-one-half inches in length and placed in a spaced-apart position from said blade and substantially parallel thereto with said stem between said hook and said blade, said hook extending beyond the attachment point of said stem to said blade whereby said troweling tool can be stored with said handle positioned outside of a container having a lip with said handle acting as a counterweight for said blade, while said blade is stored inside the container when the lip of the container is positioned between said hook and said blade and said troweling tool is supported on the lip.

7. The troweling tool of claim 6 wherein said hook is attached to said handle, and said handle and said hook are made as a single unit from molded construction.

8. The troweling tool of claim 6 wherein said hook is attached to said stem.

9. The troweling tool of claim 6 wherein said troweling tool further comprises said blade having enlarged width and length dimensions of approximately three inches and eight-and-pone-half inches, respectively.

10. The troweling tool of claim 6 wherein the blade has a thickness dimension of approximately one-sixteenths of an inch.

* * * * *